United States Patent [19]

Lang

[11] Patent Number: 4,869,595

[45] Date of Patent: Sep. 26, 1989

[54] HYDRAULIC DIFFUSION FLASH MIXING

[75] Inventor: John S. Lang, Arcadia, Calif.

[73] Assignee: James M. Montgomery, Consulting Engineers, Inc., Pasadena, Calif.

[21] Appl. No.: 709,354

[22] Filed: Mar. 7, 1985

Related U.S. Application Data

[63] Continuation of Ser. No. 519,118, Aug. 1, 1983, abandoned.

[51] Int. Cl.[4] ..... B01F 3/08

[52] U.S. Cl. ..... 366/137; 366/173; 366/177; 366/348

[58] Field of Search ..... 137/896; 210/198.1, 210/205, 206, 738; 239/424.5, 425; 366/136, 137, 167, 173, 176, 177, 183, 341, 348; 261/76, DIG. 75

[56] References Cited

U.S. PATENT DOCUMENTS

| | | | |
|---|---|---|---|
| 2,370,772 | 3/1945 | Bowers | 210/206 |
| 3,271,304 | 9/1966 | Valdespino | 366/137 |
| 3,476,318 | 11/1969 | Eckert | 239/424.5 |
| 3,675,901 | 7/1972 | Rion | 366/178 |
| 3,735,778 | 5/1973 | Garnier | 137/896 |
| 3,775,314 | 11/1973 | Beitzel | 210/198.1 |
| 4,130,365 | 12/1978 | Sittig | 366/137 |
| 4,413,784 | 11/1983 | Dea | 239/426 |

*Primary Examiner*—Frankie L. Stinson

*Attorney, Agent, or Firm*—Christie, Parker & Hale

[57] ABSTRACT

Chemicals are injected and mixed in a fluid to be treated by hydraulically creating turbulence for mixing across the cross-section of the flow path of the fluid and injecting undiluted chemical into the turbulence.

6 Claims, 3 Drawing Sheets

CLOSED PINTLE NOZZLE

OPEN PINTLE NOZZLE

HYDRAULIC DIFFUSION FLASH MIXING

This is a continuation of application Ser. No. 519,118 filed Aug. 1, 1983 and now abandoned.

FIELD OF THE INVENTION

This invention relates to mixing chemicals in a fluid stream and more particularly to hydraulic diffusion flash mixing of coagulants in water treatment and waste water treatment.

BACKGROUND OF THE INVENTION

Chemical coagulants have long been used in water and waste water treating to induce flocculation of particles suspended in the raw water to be treated. This aggregation of suspended particles allows for more efficient sedimentation and/or filtering downstream. For best results, the initial mixing of the chemical coagulant with the raw water should occur as rapidly as possible to form a homogenized mixture within one or two seconds.

The principal objective of this rapid or flash mixing is to ensure a homogeneous coagulation by completely uniform dispersion of the coagulant throughout the water. In this way, the coagulant can make contact with the maximum number of suspended particles prior to the completion of hydrolysis, enabling intermediate complexes to destabilize the suspended particles initiating aggregation. This chemistry of destabilization sets some of the requirements for efficient rapid mixing.

Chemical coagulants should be dispersed in an unblended stream of raw water. Dispersing chemicals into a blended or partially blended stream (backmixing) can lead to poor destablization of a fraction of the particles because some might have insufficient surface coverage while others might have too extensive surface coverage by adsorbed chemical species. This wastes chemicals and results in less effective floc formation for a given amount of a coagulant.

Stagnation time, defined as the amount of time that elapses from the addition of coagulant to the start of mixing, should be reduced for most effective coagulation.

From a mechanical point of view, a rapid mixing device should be simple, practical and relatively inexpensive and should not create appreciable head losses.

Through the years, in attempting to meet these chemical and mechanical requirements, many devices have been employed to provide the rapid mixing needed for chemical dispersion. These include the weir, the Parshall Flume, rapid mixing chambers equipped with mechanical rotary mixing devices such as propellers or turbines and in-line blenders. More recently, hydraulic diffusion flash mixing has been used as a method providing rapid mixing without appreciable head losses and lower operating and maintenance costs than mechanical methods. This method also provides more efficient rapid mixing with reductions of 20 to 30 percent in chemical coagulant consumption over mechanical methods.

Generally hydraulic diffusion flash mixing operates by drawing off a portion of the raw water to be treated into a carrying water loop. The chemical coagulant to be dispersed is added to this drawn off portion. The mixture of raw water and coagulant is then injected into the remainder of the raw water through a diffuser. A pump in the carrying water loop provides the pressure for injection.

Usually the diffuser is a radial jet diffuser which injects the raw water and coagulant mixture perpendicular to the flow direction of the remaining raw water from several nozzles equally spaced about the circumference of a tube placed in the center of the pipe carrying the remaining raw water. Radial injection can also occur by injection perpendicular to the flow direction from nozzles equally spaced about the pipe periphery. This alternate reduces head losses but because turbulent velocity intensity increases from the center of the pipe toward the wall, a jet introduced at the center of the pipe receives more mixing than one being introduced from the wall, so central injection is preferred.

Sometimes the diffuser is a conical jet diffuser which injects the raw water and coagulant mixture parallel to the flow direction of the remaining raw water through a single nozzle, directed either upstream or downstream with the flow, located in the center of the pipe carrying the remaining raw water. These alternatives are not preferred because a nozzle directed upstream causes backmixing and one directed downstream requires a long time for complete mixing. Both these situations do not provide most efficient coagulant use.

Problems have developed with hydraulic flash diffusion mixing in some applications. Where hardness exists in the raw water to be treated, addition of coagulant in the carrying water loop has led to clogging of the diffuser nozzles. This clogging requires periodic plant shutdowns be scheduled to clean the diffuser resulting in greatly increased operating and maintenance costs. In one case, this cleaning was necessary so frequently (once a month) the system had to be abandoned for less efficient mechanical methods.

SUMMARY OF THE INVENTION

The present invention overcomes the problems of clogging and inefficient mixing by creating turbulence in the fluid stream, such as water, to be treated and injecting the chemicals to be mixed at the point of turbulence. Preferably, the turbulence is created by injecting a fluid under pressure into the water to be treated. The fluid may advantageously be drawn off from the water to be treated and pumped through diffuser nozzles into the fluid stream or water to be treated. For most efficient mixing, the nozzles are positioned to inject the fluid perpendicular to the flow of the water and the chemical is injected into the fluid near the outlet of the nozzles to cause mixing of the chemical with the fluid.

The diffuser nozzles and chemical nozzles are arranged in the pipe carrying the fluid to be treated to provide a uniform distribution of chemical through the cross-section of the fluid stream at the point of turbulence and injection of the chemical.

For a further understanding of the invention and further objects, features, and advantages thereof, reference may now be had to the following description taken in conjunction with the accompanying drawings.

DRAWINGS

DESCRIPTION OF THE PREFERRED EMBODIMENT

Figure 1:
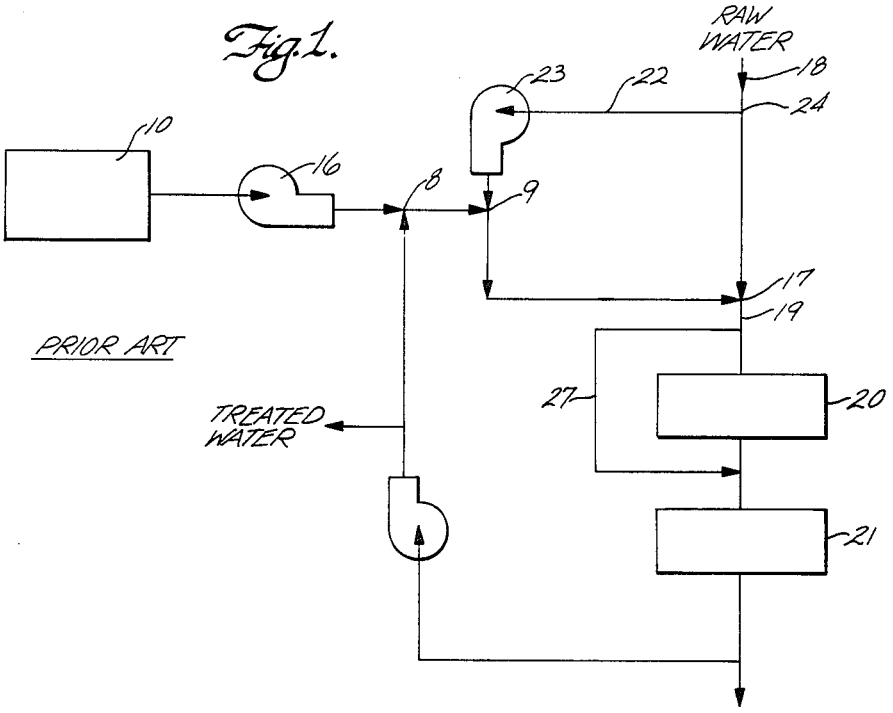
FIG. 1 is a schematic illustration of a conventional chemical mixing system.

This invention relates broadly to the mixing of one or more chemicals in a fluid stream. However, it will be disclosed in a system for treating waste water where a coagulant, such as alum, is mixed with the raw water to induce flocculation of the suspended particles.

Hydraulic diffusion flash mixing is used in certain applications because it is the most efficient. A prior art system employing this type of mixing is shown in FIG. 1 for the treatment of raw water in a water treatment or sewage treatment plant.

In this system the raw water 18 that is to be treated has a chemical added or mixed in to induce flocculation. The preferred rapid mixing is accomplished by drawing off a portion of the raw water 18 into a carrying loop 22 where the coagulant is added as schematically shown in FIG. 1 at a junction 9. The drawn off water is pressurized by a pump 23 so that the coagulant in the carrying water is mixed in the raw water by the turbulence caused by reinjecting the carrying water back into the fluid stream at a higher pressure as shown schematically in FIG. 1 at junction 17. This is done through nozzles (shown in FIG. 4) to effect hydraulic flash mixing. A coagulant storage tank 10 feeds a chemical feed pump 16. The chemical feed pump 16 meters a predetermined amount of coagulant for addition in the carrying water loop 22 at junction 9 after being diluted with treated water as shown in FIG. 1 schematically at junction 8. Flash mixing takes place in the system at junction point 17 where the raw water 18 to be treated is mixed with the coagulant and carrying water. The treated water 19 goes to a flocculation flocculation area 20. Thereafter, the water and floc mixture pass through a sedimentation area 21 and is, after this stage, filtered and distributed as treated water. In some applications, the slow mix flocculation in area 20 is bypassed as represented by bypass line 27, and pipe turbulence alone is relied upon for particle aggregation before sedimentation or filtering.

Figure 2:
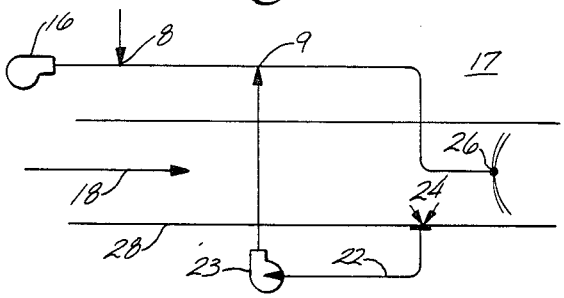
FIG. 2 is a schematic illustration of the carrying water loop and the radial jet diffuser of the system in FIG. 1.

FIG. 2 shows a schematic detail of the flash mixing equipment at junction 17 of FIG. 1. The raw water 18 is fed through raw water pipe 28 to a conventional hydraulic diffusion flash mixing system. Here part of the raw water 18 is drawn off into carrying water loop 22 and feeds a flash mixer pump 23 which supplies the pressure for injection of the carrying water 24 and the coagulant into the raw water. This mixture is injected through a radial jet diffuser 26.

Figure 3:
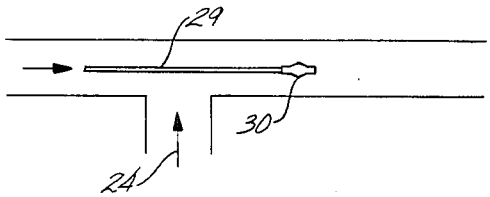
FIG. 3 is a schematic illustration of a circulating tank eductor of the system of FIG. 2.

FIG. 3 shows a schematic detail of the junction 9 where the coagulant is added to the carrying water in a conventional hydraulic diffusion flash mixing system. Here the coagulant (after dilution with treated water) is added to the carrying water 24 through a hollowtube 29 connected to a circulating tank eductor 30. Addition of coagulant to the carrying water 24 at this point upstream of the radial jet diffuser 26 introduces stagnation time because some time elapses before the coagulant is dispersed into the main flow of raw water 18 by the radial jet diffuser 26. This method of coagulant addition is discussed by Junn-Ling Chao and Brian G. Stone in their report "Initial Mixing by Jet Injection Blending" in the *Journal of the American Water Works Association,* October 1979 issue, at page 570. Dilution of some coagulants in the carrying water 24 is seen as necessary in that it may improve the effectiveness of the coagulant, such as alum, even though stagnation time is introduced. However, the degree of dilution depends on the dose, the flow rate of the raw water 18, and the amount of carrying water 24 circulated. When the flow rate of raw water 18 drops below maximum capacity, the coagulant, such as alum, should also decrease; but the amount of carrying water 24 being circulated must be kept up to provide the necessary flash mixing so a lower coagulant dose will be over diluted. This leads to early particle destabilization and aggregation lowering the coagulant efficiency and compounding clogging problems.

Figure 4A:
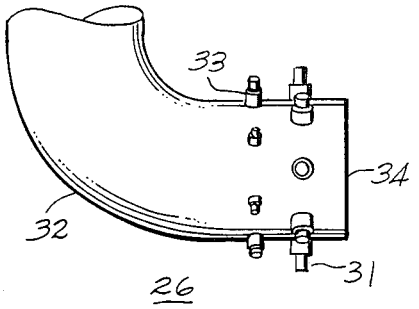
FIG. 4A is a side view drawing of a conventional radial jet diffuser of FIG. 2.
Figure 4B:
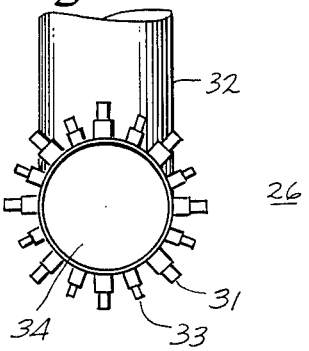
FIG. 4B is a front view drawing of the conventional radial jet diffuser of FIG. 4A.

FIG. 4A shows a side view of the radial jet diffuser 26 of FIGS. 2 and 3. This is a conventional radial jet diffuser 26 now in actual use and subject to clogging. The diffuser consists of a tube 32 having large injection nozzles 31, equally spaced about the circumference, and small injection nozzles 33, also equally spaced about the circumference, but aligned to be between the large injection nozzles 31 (see FIG. 4B). This arrangement of nozzles provides a spray pattern that will direct coagulant throughout the cross-section of the raw water pipe 28. The end of the tube 32 is closed off by a welded plate 34 to force all the carrying water 24 containing coagulant out through the nozzles. FIG. 4B shows a front view of the radial jet diffuser 26 shown in FIG. 4A where the spacing of the large injection nozzles 31 and the small injection nozzles 33 is readily apparent.

To overcome the problems encountered in the prior art, the method and apparatus of this invention provides for adding the coagulant directly to the raw water to be treated. A portion of the raw water is drawn off from the main stream of raw water and injected through nozzles at a high pressure to cause turbulence for mixing. The coagulant is injected into the raw water close to the point of injecting the pressurized drawn off raw water.

Figure 5:
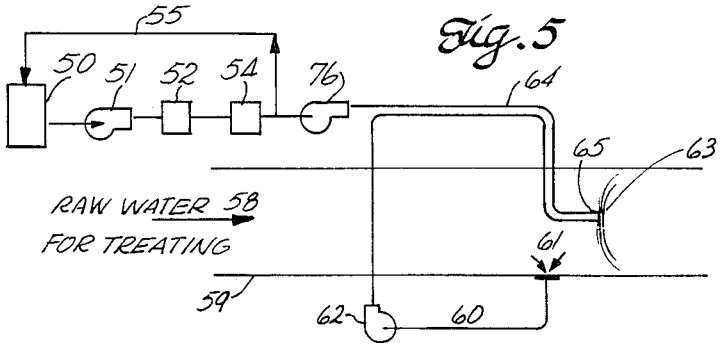
FIG. 5 is a schematic illustration of a chemical mixing system in accordance with the present invention.

Apparatus for hydraulic jet mixing by adding the coagulant directly to the raw water at the point of turbulence caused by the fluid injected under a high pressure is shown in FIGS. 5 and 6.

Preferably, the pressurized drawn off fluid is injected near the center of the fluid stream and is directed tangential to the flow of the stream for most uniform and thorough dispersion of the added chemical or chemicals in the fluid stream. The chemicals are injected into the jet stream of the pressurized drawn off fluid near the outlet of the injection nozzles. The chemicals are preferably added near the outlet for the pressurized drawn off fluid and is carried throughout the cross-section of the fluid stream at the point of turbulence caused by the high pressure fluid injected through the radial jet diffuser for rapid and efficient mixing.

FIG. 5 shows a schematic detail of the system for flash mixing where the raw water 58 is fed through raw water pipe 59 to a hydraulic diffusion flash mixing system that incorporates the present invention. Part of the raw water 58 is drawn off into a flash mixing loop 60 which, unlke the carrying water loop 22 of FIG. 2, does not have coagulant added to it. The flash mixing water 61 drawn into this loop feeds a flash mixer pump 62 which supplies the pressure for injection through the radial jet diffuser 63 creating the turbulence for rapid mixing. The invention as shown has a separate coagulant line 64 feeding a high pressure manifold 65 located near the radial jet diffuser 63. Coagulant is injected through the manifold 65 into the jet streams formed at the outlets of the diffuser 63. By removing the coagulant from injection through the diffuser nozzles after being diluted, the possibility of clogging of these nozzles is essentially eliminated. To minimize the clogging of the nozzles attached to manifold 65, the coagulant is first treated before injection through the nozzles.

The coagulant is supplied from a storage tank 50 and pumped by a pump 51 through a duplex strainer 52 and a cartridge filter 54 for removing particles. A portion of the coagulant at the output of strainer 54 is recirculated through loop 55 back to the storage tank 50. The balance of the filtered and strained coagulant is supplied to pump 76 for injection through manifold 65 into the water to be treated.

Figure 6A:
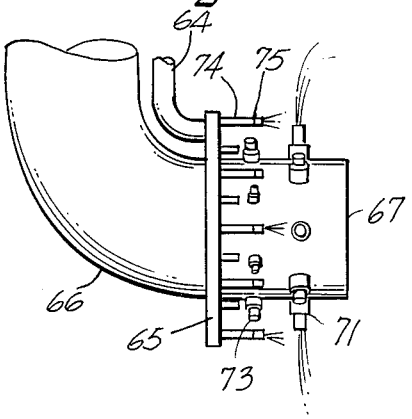
FIG. 6A is a side view of a radial jet diffuser and coagulant injecor in accordance with the present invention.

FIG. 6A shows a side view of the radial jet diffuser 63 of the present invention shown schematically in FIG. 5. The radial jet diffuser 63, shown in greater detail in FIG. 6, includes a pipe 66 at the end of which are located nozzles 71 and 73. These nozzles are positioned around the periphery of the pipe to inject the flash mixing fluid into the raw water to create turbulence for mixing. The jets are of a size and are positioned to carry the coagulant (when present) throughout the cross-section of the fluid stream at the location of the diffuser for the most efficient mixing. Large jets 71 are positioned closer to the end of the pipe, while smaller jets 73 are positioned farther from the end. The end of the pipe 66 is closed by a plate 67. The position and size of the jets may of course be altered as required for most efficient mixing.

A manifold 65 is positioned around the pipe 66 on one side of the nozzles 71 and 73. The manifold can also be positioned between the rows of large and small nozzles 71 and 73. A coagulant line 64 feeds by a pump 76 the high pressure manifold 65 as shown in FIG. 5 and in more detail in FIG. 6. From the high pressure manifold 65 for each large injection nozzle 71 and small injection nozzle 73 is a hollow stem 74 leading to a coagulant injection nozzle 75. The outlet end of each nozzle 75 is adjacent the outlet end of a large nozzle 71 or small nozzle 73. Through these coagulant injection nozzles 75, coagulant is injected into the jets of flash mixing water 61 coming from each diffuser nozzle. In this method of coagulant addition, injection occurs right at the point of mixing so stagnation time is minimized. Also, the coagulant is added in concentrated form keeping the scale of equipment small while avoiding clogging since the coagulant concentrate does not precipitate. Dilution of the coagulant takes place as part of the mixing. Use of undiluted coagulant at this point of mixing permits the coagulant to be easily reduced for lower raw water flow rates without overdilution or clogging. In this way, the present invention can save coagulant compared with conventional hydraulic diffusion flash mixing. Also, coagulants which do not require dilution to be effective can be used with greater efficiency using the present invention giving greater flexibility in choosing a coagulant.

Figure 6B:
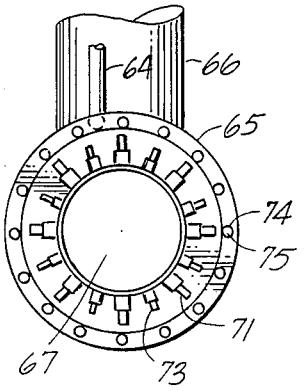
FIG. 6B is a front view of the radial jet diffuser and injector of FIG. 6A.

FIG. 6B shows a front drawing of the radial jet diffuser of the present invention. The spacing of the large injection nozzles 71 and small injection nozzles 73 each paired with a hollow stem 74 and coagulant injection nozzle 75 can be seen.

Figure 7A:
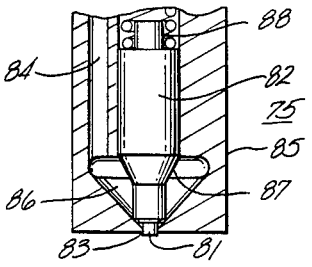
FIG. 7A is a schematic illustration of a physical embodiment of the injector of FIGS. 5 and 6 shown in the closed position.
Figure 7B:
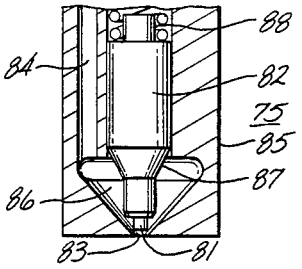
FIG. 7B is a schematic illustration of the injector shown in the open position.

FIG. 7A shows schematic illustration of a physical embodiment of a coagulant injection nozzle 75 in the closed position. This type of coagulant injection nozzle 75 is a hydraulically operated, spring-loaded needle valve very similar to a pintle type diesel fuel injection nozzle. Attached to the tip of the valve 82 is a pin 81 which has a diameter only slightly smaller than the orifice 83 in the tip of the nozzle body 85. The action of the pin 81 in the orifice 83 prevents the formation of scale deposits and makes the coagulant injection nozzle 75 non-plugging. In this embodiment of the invention, the chemical feed pump is a piston type pump operating at 50 to 300 strokes per minute delivering coagulant via the coagulant line 64 to the coagulant high pressure manifold 65, from there down each stem 74 to a duct 84 in the nozzle body 85 and filling a reservoir 86 around the valve 82. With each pressure pulse delivered by the piston movement of the chemical feed pump 76, the force on valve surface 87 is enough to oppose spring 88, opening the coagulant injection nozzle 75 for a moment as shown in FIG. 7B. The coagulant passes through a narrow ring-shaped orifice 83 forming a spray jet in the form of a hollow cone. By suitably shaping pin 81, the spray jet can be adjusted from a compact cone with good penetration to a wide angled cone with better atomization but poorer penetration. Here the coagulant spray jet will cross the gap of relatively still water existing between the coagulant injection nozzle 75 and the jet formed by the flash mixing water 61 jet. The more rapid cycling of the chemical feed pump 76 piston is preferred to make the injection of coagulant as much like continuous injection as possible to maximize the number of suspended particles in the raw water 58 that will come into contact with coagulant.

Figure 8:
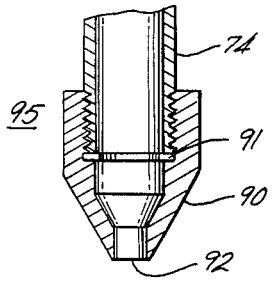
FIG. 8 is a schematic illustration of a physical embodiment of an alternative injector.

FIG. 8 shows a schematic illustration of a physical embodiment of an alternative coagulant injection nozzle 95. This type of coagulant injection nozzle is a single-hole nozzle that is always open. The nozzle body 90 merely screws onto a stem 74 with gasket 91 used to prevent leaking. In this embodiment of the invention, the chemical feed pump 76 is a positive displacement type pump delivering coagulant at a continuous pressure via the coagulant line 64 to the coagulant high pressure manifold 65. from there down each stem 74 and through the orifice 92 in the nozzle body 90. Unlike the pintle nozzle of FIG. 7, this nozzle has no mechanical action to prevent clogging. However, as is also true for the pintle nozzle, the momentum of the coagulant spray minimizes formation of scale deposits with the concentrated form of coagulant preventing precipitation. This nozzle will deliver continuous injection of coagulant.

Figure 9A:
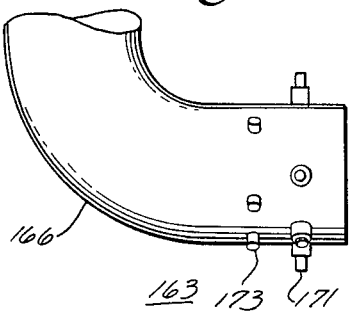
FIG. 9A is a side view of an alternative radial jet diffuser.

FIG. 9A shows a side view of a schematic illustration of an alternative radial jet diffuser 163 attached to a pipe 166. This diffuser shows more frequent spacing of the small injection nozzles 173 and large injection nozzles 171 on one side of the diffuser. This type of radial jet diffuser accomodates an unsymmetrical flow pattern in the raw water pipe 59. If coagulant addition occurs just downstream of a bend in the raw water pipe 59, more water will be flowing past the diffuser on the outside of the bend than on the inside. To insure equal distribution of the coagulant, a radial jet diffuser 163 like the one shown in FIG. 9A can be used with the side of the diffuser that has the larger number of jets facing the outside of the bend. The nozzles 75 for coagulant injection will be similarly positioned to provide coagulant at each nozzle 171 and 173.

Figure 9B:
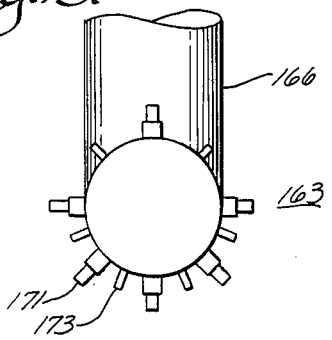
FIG. 9B is a front view of the radial jet diffuser of FIG. 9A.

Another way to handle unsymmetrical flow patterns involves placing large injection nozzles 171 on the lower half of the diffuser 163 and small injection nozzles 173 on the top half. FIG. 9B shows a front view of the radial jet diffuser 163 shown in FIG. 9A to make the unequal spacing of nozzles readily apparent.

Coagulant injection in accordance with this invention can also be used to improve chemical efficiency and prevent clogging in conjunction with less preferred methods of hydraulic diffusion than a radial jet diffuser. The invention can be applied to radial jet diffusion from nozzles about the periphery of the raw water pipe 28, to conical diffusion directed upstream, or conical diffusion directed downstream. While these methods do not provide the same magnitude of improved chemical efficiency over mechanical mixing methods as the radial jet diffuser 63, their chemical efficiency can be further improved and their clogging problems eliminated through use of the present invention.

The inventor also realizes this invention has general application where a small amount of chemical must be rapidly dispersed into a large process stream by hydraulic diffusion flash mixing and where the chemical's effectiveness is enhanced by reduced stagnation time.

The foregoing disclosure and drawings are merely illustrative of this invention and are not to be interpreted in a limiting sense.

What is claimed is:

1. Apparatus for injecting and mixing chemicals in a liquid stream comprising a first pipe for carrying the liquid stream, hydraulic means for injecting a fluid into the liquid stream carried by the first pipe to create turbulence in a selected area in the liquid stream, the hydraulic means including a diffuser located near the center of the first pipe and having a plurality of radial nozzles positioned to inject a high pressure fluid perpendicular to the longitudinal axis of the first pipe, means for injecting chemicals directly into the liquid stream in the area of turbulence, the means for injecting chemicals comprising a manifold positioned around the diffuser on one side of the radial nozzles, a plurality of nozzles connected to the manifold, each having an outlet near the outlet of a radial nozzle, and means for supplying the chemicals to the manifold under pressure.

2. Apparatus for injecting and mixing chemicals in a liquid stream comprising a first pipe for carrying the liquid stream, hydraulic means for injecting a fluid into the liquid stream carried by the first pipe to create turbulence in a selected area in the liquid stream, the hydraulic means comprising a second smaller pipe positioned near the cross-sectional center of the first pipe and connected to a source through the side of the first pipe, at least one diffuser nozzle attached to the end of the second pipe, and means for supplying a pressurized fluid to the diffuser nozzle, and means for injecting chemicals directly into the liquid stream in the area of turbulence comprising a manifold positioned around the second pipe, at least one chemical injection nozzle attached to the manifold and having an opening near the opening of a diffuser nozzle, and means for supplying chemicals to the chemical injection nozzle.

3. Apparatus for injecting and mixing chemicals in a liquid stream comprising a first conduit for carrying the liquid stream one or more turbulence-created nozzles positioned in the liquid stream with the outlet of each nozzle directed normal to the direction of flow of the liquid stream one or more chemical injection nozzles positioned near the outlet of a turbulence-created nozzle for injecting chemical directly into the liquid stream in the turbulence created at the outlet of the turbulence-created nozzles.

4. An apparatus in accordance with claim 3 wherein the turbulence-creating nozzles are mounted on a diffuser located near the cross-sectional center of the first conduit and are directed radially out from the central area of the first conduit.

5. An apparatus in accordance with claim 3 further comprising means for drawing off a portion of the liquid from the stream and means for causing the portion of the liquid to flow through the turbulence-creating nozzles.

6. Apparatus for injecting and mixing chemicals in a liquid stream comprising:

a first conduit for carrying the liquid stream, one or more turbulence-created nozzles positioned in the liquid stream with the outlet of each nozzle directed normal to the direction of flow of the liquid stream, one or more chemical injection nozzles positioned near the outlet of a turbulence-creating nozzle for injecting chemical directly into the liquid stream in the turbulence created at the outlet of the turbulence-creating nozzles, wherein the turbulence-creating nozzles are mounted on a diffuser located near the cross-sectional center of the first conduit and are directed radially out from the central area of the first conduit and wherein the chemical injection nozzles are mounted on a manifold positioned around the diffuser on one side of the radial nozzles and further comprising means for supplying the chemicals to the manifold under pressure.

* * * * *